United States Patent [19]

Baugh

[11] Patent Number: 4,580,631

[45] Date of Patent: Apr. 8, 1986

[54] LINER HANGER WITH LOST MOTION COUPLING

[75] Inventor: Hollis A. Baugh, Houston, Tex.

[73] Assignee: Joe R. Brown, Houston, Tex.

[21] Appl. No.: 701,853

[22] Filed: Feb. 13, 1985

[51] Int. Cl.[4] ..... E21B 23/00

[52] U.S. Cl. ..... 166/208; 166/210; 166/216; 166/382

[58] Field of Search ..... 166/134, 138, 208, 210, 166/216, 217, 382; 285/39

[56] References Cited

U.S. PATENT DOCUMENTS

| | | | |
|---|---|---|---|
| Re. 30,988 | 7/1982 | Crickmer | 166/217 |
| 2,670,045 | 9/1948 | Armentrout | 166/208 X |
| 3,195,646 | 7/1965 | Brown | 166/208 |
| 3,382,927 | 5/1968 | Davis, Jr. | 166/208 X |
| 3,570,599 | 3/1971 | Wilson et al. | 166/208 |
| 3,910,349 | 10/1975 | Brown et al. | 166/208 X |
| 4,311,194 | 1/1982 | White | 166/208 X |

OTHER PUBLICATIONS

*Composite Catalog of Oil Field Equipment and Services,* published by World Oil, 1978–1979, pp. 1058–1065.

*Primary Examiner*—Stephen J. Novosad
*Assistant Examiner*—John F. Letchford
*Attorney, Agent, or Firm*—Browning, Bushman, Zamecki & Anderson

[57] ABSTRACT

Disclosed is a support structure, such as a liner hanger, for use in a well, including an assembly of slips for wedging to the interior surface of the surrounding well, but maintained off of wedging surfaces in a running in configuration by a drag assembly and latch mechanism connected to the hanger body carrying the wedges. As the latch is configured to permit setting of the support structure, a lost motion coupling joining the slip assembly with the drag and latch assembly permits rotational and limited longitudinal movement therebetween as the slip system moves rotationally, and possibly longitudinally to a limited extent, with the hanger body relative to the drag assembly.

21 Claims, 9 Drawing Figures

LINER HANGER WITH LOST MOTION COUPLING

BACKGROUND OF THE INVENTION

1. Field of the Invention

The present invention pertains to techniques for coupling members while permitting mutual relative movement. More particularly, the present invention relates to techniques for anchoring support structures in wells or the like, such as liner hangers utilized to support liners while they are being connected in place. As used herein, wells are meant to include without limitation all types of holes in the ground, including for example oil and gas wells, water wells, ventilation shafts, fluid communication conduits, tunnels and the like. While the invention is disclosed herein as embodied in a liner hanger used in oil and gas wells for supporting liners while the liners are being cemented in place, the present invention may be provided in any appropriate form to support any other type of equipment, for example.

2. Brief Description of the Prior Art

Liner hangers for positioning and supporting liners for cementing in oil and gas wells, for example, are known having an array of slips carried about a generally tubular member which also features corresponding wedging, or cone, surfaces. Setting the liner hanger involves positioning the wedges and slips so that the wedges are generally radially, or transversely, aligned with corresponding slips to wedge the slips radially outwardly against the surrounding well surface, usually the surface of casing or another liner already positioned within the well. In this way, the liner hanger is anchored to the well and supported thereby, and in turn can support the liner being cemented in position. During the process of running in the liner and liner hanger within the well, the liner hanger must be configured to avoid such radial alignment of the slips and wedges. Consequently, the setting operation also includes at least one step to move the liner hanger out of the running in configuration so that the slips and wedges may be appropriately aligned for anchoring to the well. In hydraulically set liner hangers, one or more frangible parts may be broken to move the liner hanger out of the running in configuration. A mechanically set liner hanger may employ the closing of a latching device or the like whereby the liner hanger may be moved to the set configuration. In such types of liner hangers, initiation of the setting procedure may be irreversible so that, if the setting procedure is inadvertently initiated, or if the apparatus becomes hung up within the well, it may become impossible to reposition the liner hanger or to retrieve the liner hanger and associated equipment to clear the well.

A pin-and-slot assembly, in the form of a J-latch for example, may be utilized to maintain the liner hanger in its running in configuration by serving to latch a slip frame, carrying the slips, to the tubular member, carrying the wedges, in the running in configuration. The liner hanger may be moved to a set configuration by maneuvering the pin or pins relative to the slot or slots of the J-latch, the slip frame being attached to a friction device such as provided by drag springs or the like which engage the surrounding well surface and permit selected movement of the tubular member relative to the slip frame. If necessary, the liner hanger may be maneuvered out of the set configuration and the J-latch repositioned to maintain the liner hanger in its running in configuration for repositioning or retrieval of the liner hanger, for example.

Setting a liner hanger fitted with a J-latch, however, includes rotating and longitudinally moving the tubular member with the wedges relative to the drag springs. Since the slip frame and slips are connected to the drag springs, prior J-latch liner hangers have been constructed with the slips rotationally offset from the corresponding wedges in the running in configuration to accommodate relative rotation between the wedges and slips in the setting operation so that the wedges may be rotationaly aligned with corresponding slips in the set configuration. Prior drag spring assemblies also supported the slip frame and slips and held them against longitudinal movement relative to the well, as the J-latch would be manipulated, requiring substantial frictional forces between the drag springs and surrounding well surface. It is desirable and advantageous to provide a mechanically set and retrievable liner hanger which may be run in and maintained throughout the setting operation with the slips rotationally aligned with the corresponding wedges. It is also desirable and advantageous to provide a coupling between the slip assembly and the drag spring assembly which permits limited longitudinal movement therebetween so that the drag spring assembly need not bear the weight of the slip frame, or hold down the slips during the setting operation.

SUMMARY OF THE INVENTION

The present invention provides support apparatus, such as a liner hanger, for use in a well, and includes an elongate hanger body carrying wedging surfaces arrayed about the transverse circumference of the hanger body. A slip frame generally circumscribes the hanger body and carries anchoring slips arrayed about the hanger body. Apparatus for frictionally engaging the surrounding well to resist longitudinal and rotative movement relative thereto is connected to the hanger body by a latch system including a first latch member provided by the friction apparatus and a second latch member provided by the hanger body. A coupling is provided to connect the friction apparatus to the slip frame. The coupling is a lost motion coupling which permits limited longitudinal movement between the slip frame and the friction apparatus.

The latch members may be positioned in a first configuration to prevent the wedging surfaces from aligning transversely with the slips to force the slips into anchoring engagement with the surrounding well. In a second configuration of the latch members, the wedging surfaces may be so positioned to wedge the slips into anchoring engagement with the surrounding well. The first and second latch members may be moved from the first configuration to the second configuration by manipulation of the hanger body with the second latch member relative to the well as the friction apparatus engages the well interior surface to resist movement of the first latch member.

During such manipulation between the latch members, the lost motion coupling permits limited movement of the slip frame and slips relative to the friction apparatus. The lost motion coupling may be constructed to include a first coupling member carried by the friction apparatus and a second coupling member carried by the slip frame and linked with the first coupling member to permit rotational motion between the slip frame and the friction apparatus and limited longitudinal motion therebetween. Each coupling member may comprise at least one arcuate flange member, or shoulder, carried on a generally elongate coupling body, and the coupling bodies may be mutually telescoped with the corresponding flange members mutually opposed to engage and so limit the relative longitudinal motion between the coupling bodies in one directional sense. At least one of the coupling bodies may comprise a plurality of circumferentially arranged collet fingers carrying flange members toward the free ends of the fingers.

The slip frame may be rotationally fixed relative to the wedging surfaces so that, as the hanger body is manipulated to move the latch member between the first configuration and the second configuration, the slip frame and slips rotate with the hanger body and wedging surfaces. The slip frame may include at least one elongate frame member constrained in a recess provided by the wedging apparatus. An appropriate cover may overlie the frame member in the recess to prevent transverse movement of the frame member relative to the recess. A spacer carried by the frame member may further constrain the movement of the frame member relative to the recess.

The present invention provides a support structure such as a liner hanger which includes slips rotationally aligned with corresponding wedging surfaces. The slip frame carrying the slips is connected to the remainder of the apparatus by the lost motion coupling so that limited longitudinal movement is permitted between the slip frame and the friction assembly. During the running in operation, the slip frame may be supported by the hanger body, rather than the friction apparatus. Consequently, multiple sets of slips and corresponding wedges may be provided displaced along the hanger body without adding to the weight to be supported by the friction assembly.

DETAILED DESCRIPTION OF THE PREFERRED EMBODIMENT

Figure 1A:
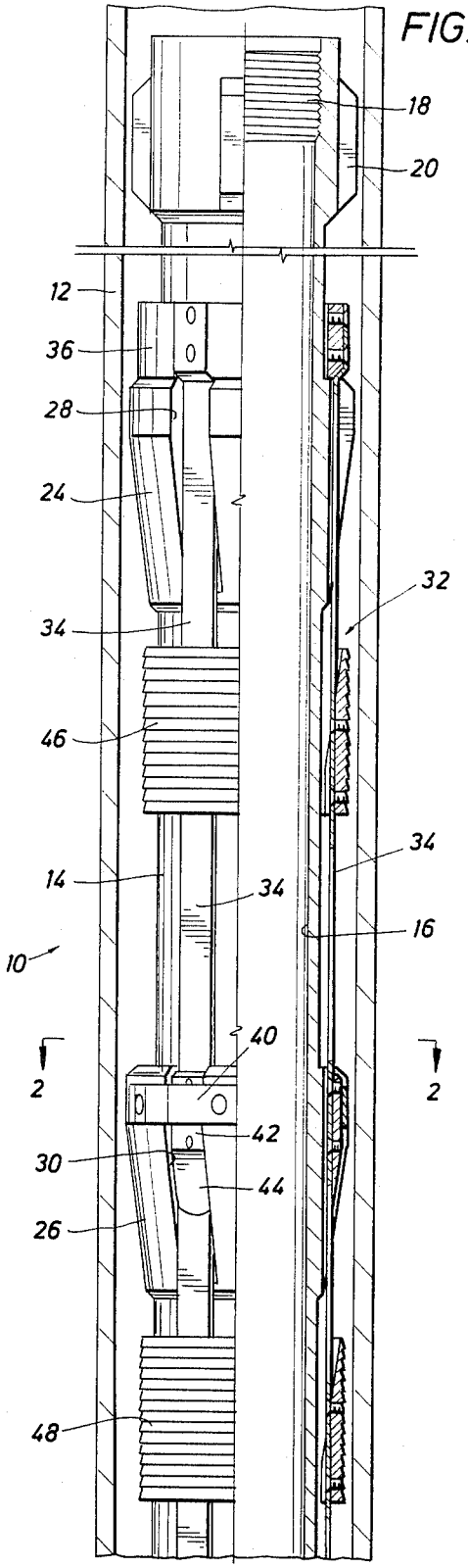
FIGS. 1A and 1B together provide an elevation in partial section of apparatus according to the present invention, including a liner hanger in running in configuration illustrated within well casing, with the apparatus being illustrated from top to bottom in FIGS. 1A and 1B, respectively.

A support structure in the form of a hanger body is shown generally at 10 in FIGS. 1A, 1B, 3, 4A and 4B, positioned within a well casing 12. While just the liner hanger 10 is thus illustrated, it will be appreciated that the hanger would typically be lowered into position within a well by means of a setting tool suspended from a pipe string, and would typically support a linear equipped with a cementing valve assembly at the lower end of the liner. The liner hanger would be manipulated to be set, that is, hung from the surrounding casing, or liner, to support the liner suspended from the hanger while the latter is cemented in place within the well. The setting tool may be selectively releasable from the liner, in which case the setting tool could be withdrawn, leaving the liner and hanger cemented in place.

The liner hanger 10 includes an elongated, generally tubular hanger body 14 featuring a longitudinally-extending central passage 16. The top of the hanger body 14 may include a threaded coupling 18 by which the hanger body may be supported from other equipment, such as a setting tool (not shown) as noted above. Centralizer lugs 20 may also be provided to help centralize the hanger 14 as it is run in the well. Similarly, the lower end of the hanger body 14 may be fitted with a threaded coupling 22 by which the hanger body may be connected to, and support, a liner suspended therebelow.

Figure 2:
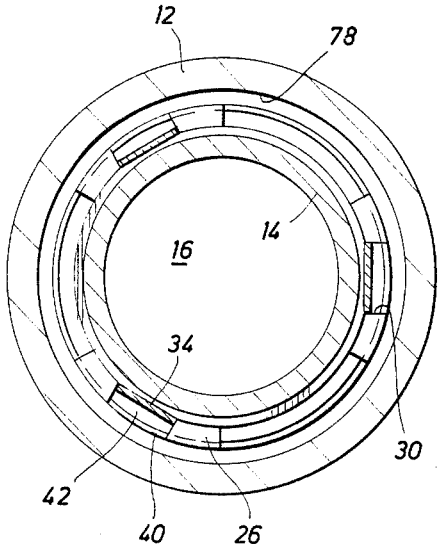
FIG. 2 is an enlarged transverse cross section taken along line 2—2 of FIG. 1A.

The hanger body 14 is fitted with multiple sets of cone, or wedging, members 24 and 26, longitudinally displaced along the hanger body with each set including multiple wedges symmetrically arrayed about the hanger body and having downwardly-facing cam, or wedging, surfaces as may be appreciated by reference to FIGS. 1A and 2. The wedges 24 and 26 are broken by corresponding longitudinally-extending recesses 28 and 30, respectively. While only two sets of wedges 24 and 26, longitudinally displaced along the hanger body 14, are illustrated, additional sets of wedges may be carried by the hanger body. Similarly, while three wedges per set are illustrated, additional wedges may be included in each set, symmetrically arrayed about the hanger body.

A slip frame, or slip cage, shown generally at 32, circumscribes the hanger body 14, and includes a plurality of elongate straps, or frame members, 34 extending between an upper slip frame ring 36 and a lower slip frame ring 38. The frame members 34 are appropriately shaped to be bolted to the upper and lower rings 36 and 38, respectively, as illustrated.

Figure 1B:
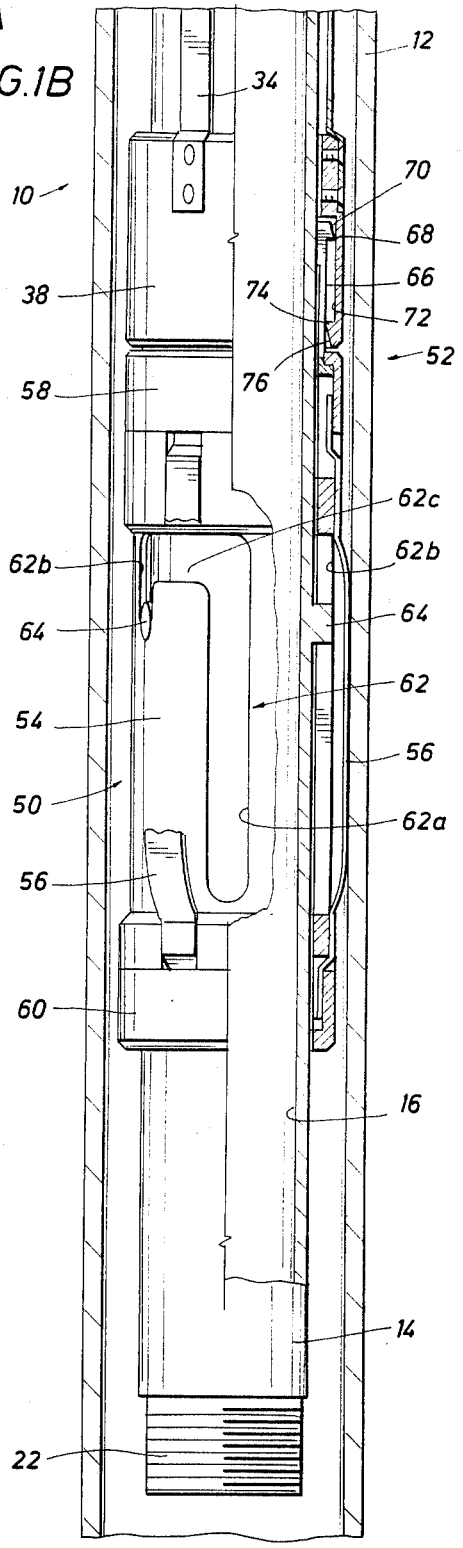

The frame members 34 reside in the wedge recesses 28 and 30, whereby the frame members and, therefore, the slip frame 32 are constrained to be rotationally fixed relative to the wedges 24 and 26 and, therefore, the hanger body 14. However, the slip frame 32 may be moved longitudinally relative to the hanger body 14. FIGS. 1A and 1B illustrate the slip frame 32 at its lowermost possible position relative to the hanger body 14, wherein the slip frame upper ring 36 abuts the top surfaces of the top wedges 24, whereby the weight of the slip frame is supported by the hanger body 14.

The lower wedge set is equipped with a retainer strap 40 which circumscribes the wedges 26 toward their widest regions and is bolted within recesses of the wedges as illustrated, providing a cover over the recesses 30 and the frame members 34 constrained therein. Each frame member 34 is fitted with a spacer 42 having a lower, downwardly-facing camming, or wedging, surface 44. In the lowermost position of the slip frame 32 relative to the hanger body 14, as illustrated in FIGS. 1A, 1B and 2, the spacers 42 lie within the recesses 30 and under the retainer 40 to maintain the frame members 34 generally close to the outer surface of the hanger body. If the slip frame 32 is moved upwardly relative to the hanger body 14 from this lowermost configuration, the camming surfaces 44 ensure that the frame members 34 are appropriately contracted toward the hanger body 14 to allow passage of the spacers 42 within the retainer strap 40 upon lowering of the slip frame. If additional wedge sets are employed, each wedge set may be fitted with a retainer strap 40 (with the possible exception of the top set as illustrated, since the ring 36 maintains the upper ends of the frame members 34 relatively close to the hanger body 14).

The slip frame 32 includes a set of anchoring slips for each set of wedges. Here, the slip frame 32 carries upper and lower sets of slips 46 and 48, respectively, corresponding to the upper and lower wedges 24 and 26, respectively, the slips being appropriately bolted to the frame members 34 as illustrated. Each of the slips 46 and 48 features, on its outer surface, an array of downwardly-facing, arcuate gripping edges which may be forced into gripping, anchoring engagement with the inner surface of the surrounding casing 12 when the slip is appropriately pressed radially outwardly by its corresponding wedging surface. As discussed in further detail hereinafter, such anchoring engagement between the slips and the casing 12 may be effected by longitudinal movement between the hanger body 14 and the slip frame 32 to transversely align the wedges with the corresponding slips, whereby the wedging surfaces urge the slips radially outwardly into such contact with the surrounding casing. The frame members 34 are sufficiently flexible to allow such lateral movement of the slips bolted thereto. However, in the lowermost configuration of the slip frame 32 relative to the hanger body 14 as illustrated in FIGS. 1A, 1B and 2, the spacers 42 cooperating with the retainer strap 40, in addition to the anchoring of the frame members to the upper and lower rings 36 and 38, respectively, maintain the frame members 34 and the slips 46 and 48 generally radially contracted against the hanger body 14. The liner hanger 10 may be inserted into the well in this configuration as illustrated in FIGS. 1A and 1B, and run in the well with contact between the slips 46 and 48 and the surrounding casing 12 minimized by virtue of the slips being so held generally toward the hanger body 14.

As illustrated in FIG. 1B, a latching mechanism, shown generally at 50, is connected to the slip frame 32 by a lost motion coupling shown generally at 52. The latching mechanism 50 includes a J-body 54, appropriately slotted to receive the upper and lower ends of a plurality of drag, or bow, springs 56 arrayed symmetrically about the J-body. Here, three such drag springs 56 are indicated, but additional drag springs symmetrically positioned about the J-body 54 may be utilized. Upper and lower spring retainer rings 58 and 60, respectively, are welded to the J-body to retain the drag springs 56 mounted on the J-body. The drag springs 56 are generally resilient, and in their relatively relaxed state mounted on the J-body extend transversely across the J-body to a distance greater than the internal diameter of the casing 12 so that, when positioned within the casing, the drag springs engage the inner surface of the casing and establish frictional forces with the casing to resist movement of the J-body relative to the casing.

The J-body 54 includes two J-slots indicated generally at 62, arranged symmetrically on the J-body as one latch member of the latching mechanism 50. Each slot 62 includes a longitudinally-extending long slot arm **62*a* and a longitudinally-extending short slot arm 62*b* connected to the long slot arm by a transverse cross slot arm 62*c*. As a second latch member of the latching mechanism 50, the hanger body 14 carries two J-pins, or lugs, 64 symmetrically positioned on the hanger body to be received in the two J-slots 62. As may be appreciated by reference to FIG. 1B, for example, the J-slots 62 and the J-pins 64 are symmetrically positioned so that each of the pins is positioned within its respective J-slot at a location corresponding, or identical, to the position of the other J-pin within its respective J-slot. While two J-slots 62 and two corresponding J-pins 64 are illustrated, the latch mechanism 50** may be constructed with any number of such J-pin-and-slot combinations.

The latch mechanism 50 serves to limit the positions the J-body 54 may take relative to the hanger body 14, and also to carry the J-body into the well with the hanger body. Within the casing 12, the relative positions of the J-body 54 and the hanger body 14 may be selectively altered, within the limitations provided by the J-pins 64 being constrained within the J-latches 62, by manipulation of the hanger body, by means of the pipe string extending to the surface, as the drag springs 56 engage the surrounding casing to resist movement of the J-body relative thereto. Thus, the J-body 54 is effectively held in position by the casing 12 as the hanger body 14 is moved relative to the casing and, therefore, the J-body.

While the J-body 54 is shown as containing the J-latches 62 and the hanger body 14 is shown carrying the J-pins 64, it will be appreciated that the J-body could maintain inwardly-extending J-pins constrained within J-slots provided on the hanger body to achieve the same effect as provided by the latching mechanism illustrated herein.

Figure 5:
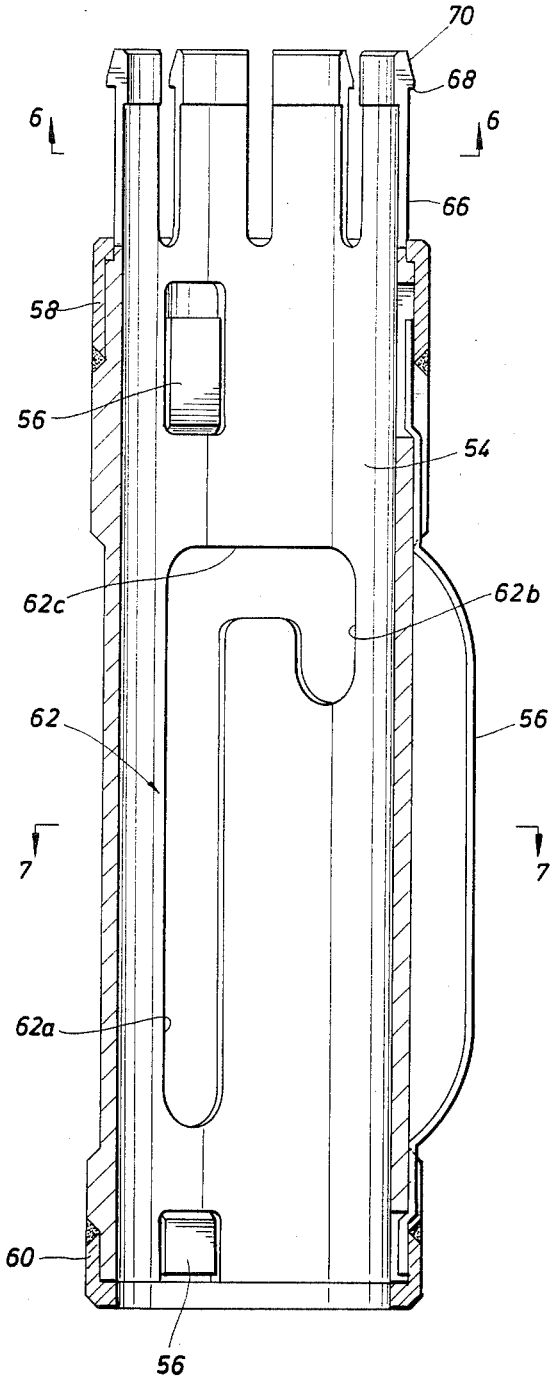
FIG. 5 is an enlarged elevation in cross section of the combination of the friction apparatus, first latch member and first coupling body of the lost motion coupling.
Figure 6:
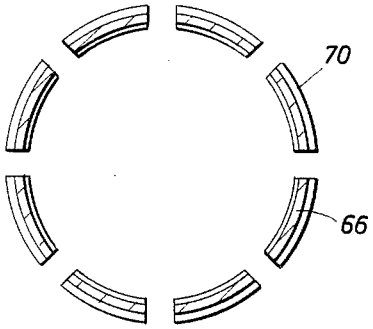
FIG. 6 is a transverse cross section taken along line 6—6 of FIG. 5.
Figure 7:
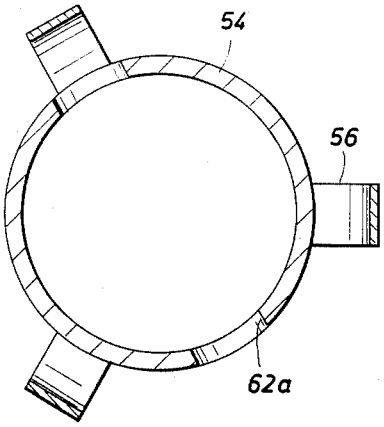
FIG. 7 is a transverse cross section taken along line 7—7 of FIG. 5.

The lost motion coupling 52 includes the upper portion of the J-body as one coupling member, comprising an array of upwardly-extending collet fingers 66 arranged symmetrically as illustrated in FIGS. 5 and 6. Each collet finger 66 includes an elongate, arcuate shank ending in a head featuring a downwardly-facing arcuate shoulder, or flange, 68 below an upwardly-facing camming surface 70. The lost motion coupling 52 further includes the lower sub-frame ring 38 as a second coupling member, providing an internal annular recess 72 limited at its lower extent by an upwardly-facing annular internal shoulder, or flange, 74 above an internal, downwardly-facing camming surface 76.

The collet fingers 66 telescope within the slip frame ring 38, with the head of the collet fingers received within the ring recess 72. The shanks of the collet fingers 66 are relatively narrow and set back from the J-body spring retainer ring 58 to accommodate the radially inward extent of the slip frame ring shoulder 74. Thus, the collet shoulders 68 face the ring shoulder 74 in opposition thereto so that the shoulders may abut to limit the extent the slip frame ring 38 may move upwardly relative to the J-body 54.

It will be appreciated that the lost motion coupling 52 may be assembled (off of the hanger body 14) by driving the collet fingers 66 upwardly into the interior of the slip frame ring 38 with the collet cam surfaces 70 riding on the ring cam surface 76 whereby the latter urges the collet fingers to flex radially inwardly. When the collet cam surfaces 70 clear the ring cam surface 76, the collet fingers 66 may snap back to their straight, relaxed configuration illustrated, with the collet fingers telescoped within the slip frame ring 38 and the collet shoulders positioned above and facing the ring shoulder.

The lost motion coupling 52 permits unlimited rotational movement between the slip frame 32 and the J-body 54 around their mutual longitudinal axes, the collet fingers 66 being able to move rotationally freely within the slip frame ring 38. Longitudinal movement between the slip frame 32 and the J-body 54 is limited in one directional sense by the eventual abutting of the collet finger shoulders 68 against the slip frame ring shoulder 74, as the slip frame is moved longitudinally away from the J-body. The slip frame 32 moving in the opposite longitudinal direction sense, toward the J-body 54, would eventually be stopped by the bottom of the slip frame ring 38 abutting the top of the drag spring retainer ring 58. However, with the hanger body 14 positioned sufficiently high relative to the J-body 54, the slip frame upper ring 36 would abut against the top of the upper set of wedges 24 on the hanger body before the lower slip frame 38 contacts the drag spring retainer ring 58, as illustrated in FIGS. 1A and 1B. Additionally, the slip frame 32 is constrained to be rotationally fixed relative to the hanger body 14 by virtue of the frame members 34 being contained within the wedge recesses 28 and 30, as noted hereinabove. Further, the extent of the longitudinal movement between the slip frame 32 and the hanger body 14 is also determined by the longitudinal position of the J-body 54 along the hanger body, which position is determined by the configuration of the latching mechanism 50, that is, by the positions of the J-pins 64 within their respective J-latches 62.

The liner hanger 10 may be run in the well, with the associated equipment (not shown) for cementing a liner and the well, in the configuration illustrated in FIGS. 1A and 1B. There, the J-pins 64 reside at the lower extremities of the short J-slot arms **62*b*, and the slip frame 32 rests on the hanger body 14 by engagement of the slip frame upper ring 36 against the top of the upper set of wedges 24, with a resulting spacing between the bottom of the slip frame lower ring 38 and the top of the drag spring retainer ring 58, and a spacing between the tops of the collet fingers 66 and the opposite surface of the slip frame ring 38. Thus, the weight of the slip frame 32 is borne directly by the hanger body 14 rather than the J-body 54 in this running in configuration. Further, the spacers 42 cooperate with the retainer bands 40 to maintain the slips 46 and 48 generally close to the hanger body 14 for minimal contact with the surrounding casing 12. If, during the running in procedure, the slip frame 32 should be displaced upwardly relative to the hanger body 14, the lost motion coupling 52 would nevertheless limit the extent of such displacement, by ultimate engagement of the collet finger shoulders 68 with the ring shoulders 74, to prohibit transverse alignment of the wedges 24 and 26 with the corresponding slips 46 and 48 to drive the slips outwardly into anchoring engagement with the surrounding casing 12**.

Figure 3:
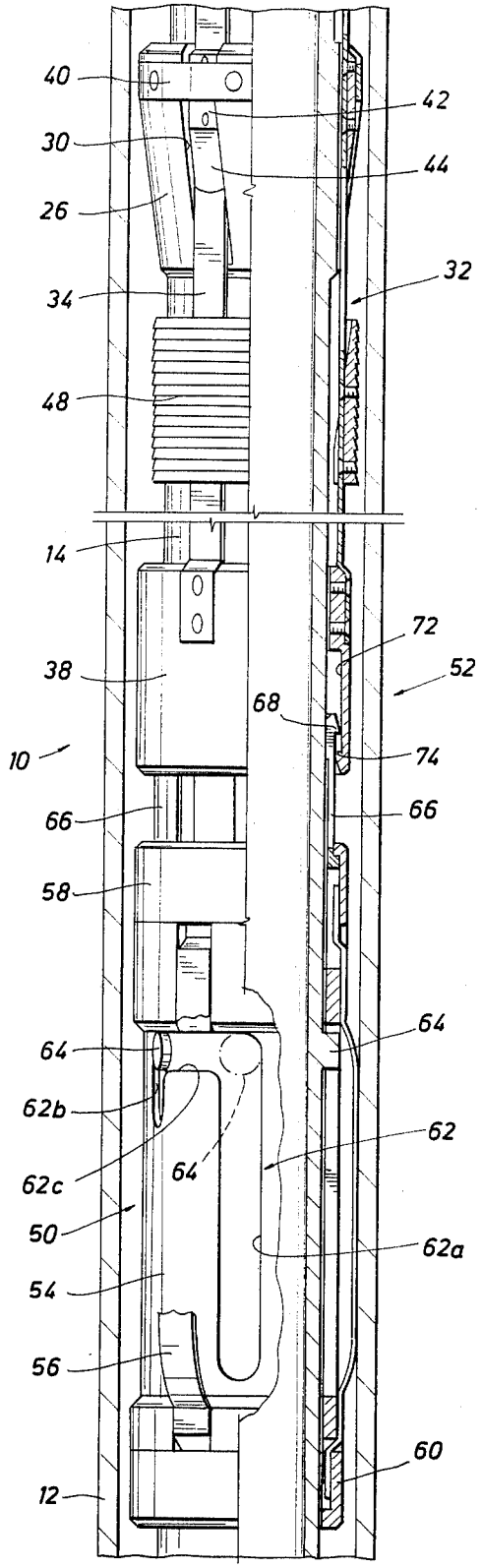
FIG. 3 is a fragmentary view similar to FIGS. 1A and 1B combined, but showing the liner hanger at a stage during the setting operation.

When the liner hanger has been positioned within the casing 12 at the location where the liner hanger is to be anchored for supporting the liner suspended therebelow for cementing purposes, the liner hanger may be set, generally by manipulation of the hanger body 14 through manipulation of the pipe string (not shown) by which the apparatus is run in the well. The pipe string is raised a short distance, to raise the hanger body 14 relative to the J-body 54, which is held against upward movement by frictional forces generated between the drag springs 56 and the surrounding casing 12. The hanger body is thus lifted to raise the J-pins 64 along the short J-slot arms **62*b* to align the J-pins with the cross J-slot arms 62*c*, as indicated in FIG. 3. During this lifting process, the rising upper set of wedges 24 raises the slip frame 32 (if not already raised) relative to the J-body 54, also as indicated in FIG. 3. Thus, the frictional forces developed between the drag springs 56 and the surrounding casing 12 need not restrain the slip frame 32 from movement relative to the casing as the hanger body 14** is raised.

With the J-pins 64 raised as illustrated in FIG. 3, the pipe string is manipulated at the surface to rotate the hanger body 14 relative to the casing 12 and to the J-body 54, which is held by the frictional forces between the drag springs 56 and the casing against rotational movement relative to the casing. The hanger body 14 is thus rotated to align the J-pins 64 with the long J-slot arms **62*a*, as indicated in phantom in FIG. 3**.

During the rotation of the hanger body 14, the slip frame 32 rotates with the hanger body and relative to the J-body, such rotation being enforced by the constraint of the frame members 34 within the wedge recesses 28 and 30, and permitted by the lost motion coupling 52. Thus, the anchoring slips 46 and 48 in each set of slips remain rotationally aligned with corresponding wedges 24 and 26, respectively, throughout the running in of the liner hanger 10 within the well, and the setting of the liner hanger.

Figure 4A:
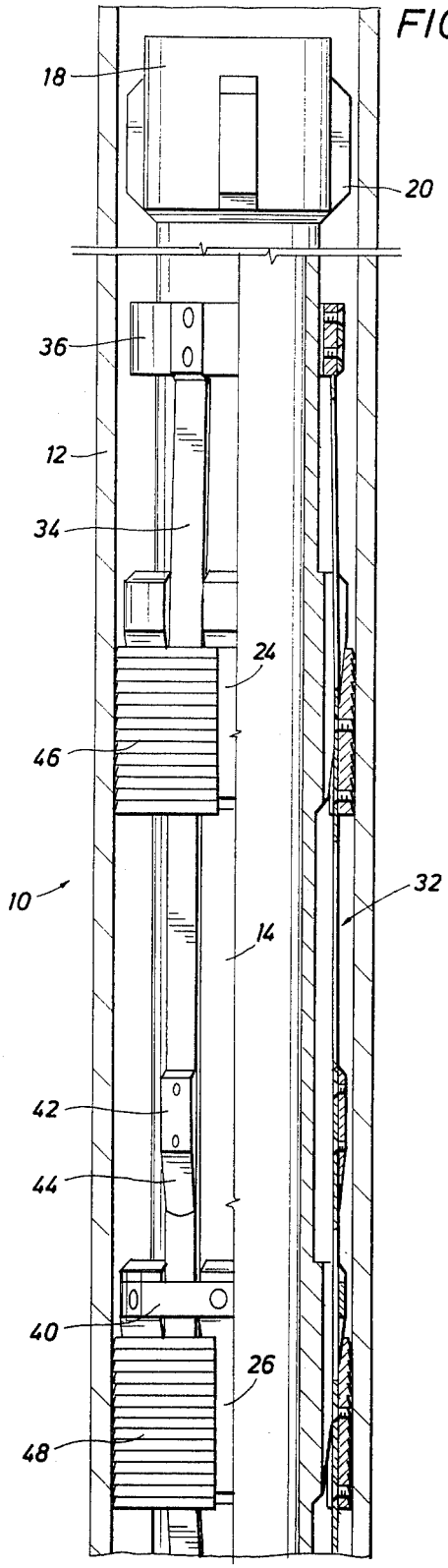
FIGS. 4A and 4B together provide a view similar to FIGS. 1A and 1B, combined, but showing the liner hanger in set configuration.
Figure 4B:
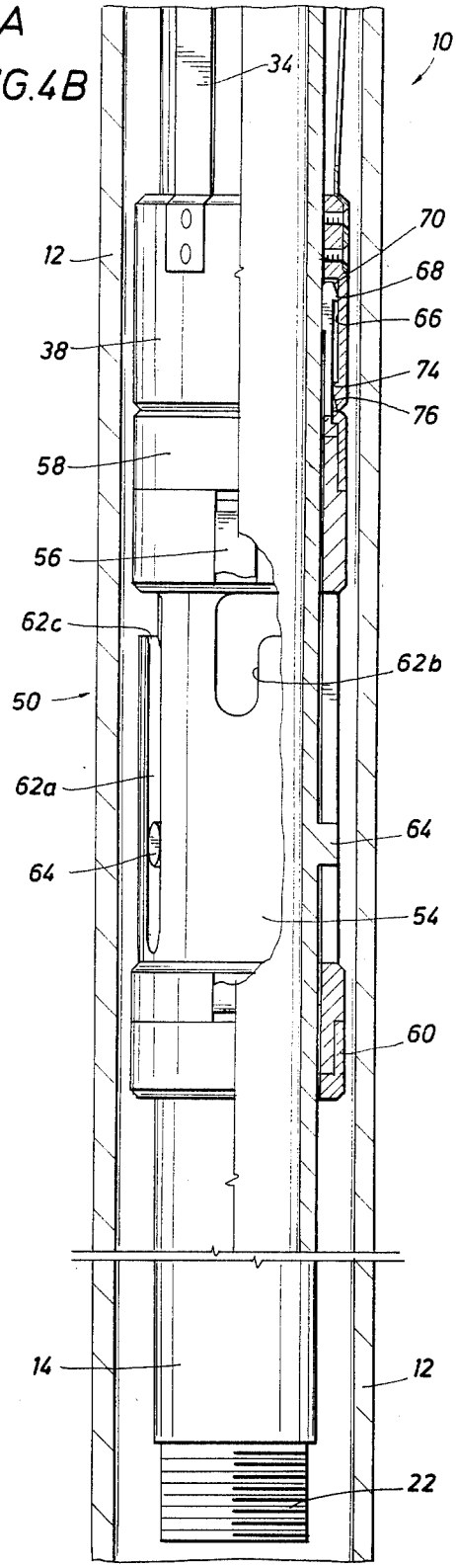

With the J-pins 64 positioned at the tops of the corresponding long J-slot arms **62*a* as indicated in FIG. 3, the pipe string may be further manipulated at the surface to lower the hanger body 14 relative to the surrounding casing 12 and, therefore, to the J-body 54 which again is held against movement relative to the casing by frictional forces between the drag springs 56 and the surrounding casing surface. The downward movement of the hanger body 14 is continued, with the J-pins 64 passing downwardly along the corresponding long J-slot arms 62*a*, until the wedges 24 and 26 move behind the corresponding anchoring slips 46 and 48 and spread them radially outwardly into anchoring engagement with the surrounding casing 12, as illustrated in FIGS. 4A and 4B. The hanger body 14 will thus be moved downwardly relative to the slip frame 32 until the slips 46 and 48 are so wedged in anchoring engagement against the casing 12, with the slip frame setting down on the J-body 54 and being held thereby against further downward movement, if necessary, to facilitate transverse alignment of the wedges 24 and 26 within the slips 46 and 48**, respectively, as shown.

It will be appreciated that the operation of setting the hanger 10 as discussed may generally be reversed, with the hanger body 14 manipulated by appropriate maneuvering of the pipe string at the surface to return the J-pins 64 to the short J-slot arms **62*b*, with the anchoring engagement of the slips 46 and 48 with the surrounding casing 12 released as the hanger body is initially raised out of the set configuration. Similarly, it will be appreciated that, although a counterclockwise, or lefthand, turn is utilized in the operation of setting the hanger 10 to move the J-pins from the tops of the short J-slot arms 62*b* across to the tops of the long J-slot arms 62*a*, the J-slots 62** may be formed to require a righthand, or clockwise, turning of the hanger body to effect setting from the running in configuration.

Since the lost motion coupling 52 permits rotation of the slip frame relative to the J-body 54, the slips 46 and 48 may be maintained rotationally aligned with their corresponding wedges 24 and 28, respectively, by the slip frame being constrained to rotate with the hanger body 14 as discussed hereinbefore. Further, the wedges and slips in the various sets displaced longitudinally along the hanger body 14 and along the slip frame 32, respectively, may be mutually rotationally aligned (as along the frame members 34) to provide relatively straight flow passages 78 along the casing 12 external to the liner hanger 10, as indicated in FIG. 2 to facilitate fluid flow along the casing 12 by the liner hanger. The latching mechanism 50 is generally free of the weight of the slip frame 32. At most, the drag springs 56 may impede downward movement of the slip frame 32 just sufficiently to allow the wedges 24 and 26 to spread the slips 46 and 48, respectively, to initiate engagement thereof with the surrounding casing in the setting operation. Consequently, the J-body 54 need not bear the weight of the slip frame 32 during the running in operation, for example. Therefore, any number of sets of wedges and slips may be added to the liner hanger 10 illustrated to increase the forces by which the liner hanger may be suspended from the casing 12 and, therefore, which are available for supporting a liner suspended by the hanger body 14, without adding to the burden which must be carried by the J-body 54, or substantially increasing the frictional forces that must be generated by the drag springs operating against the casing 12.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. Support apparatus for use in a well, comprising:

a. an elongate hanger body carrying wedge means arrayed about said hanger body;

b. anchoring slips, carried on a slip frame and arrayed about said hanger body;

c. friction means connected to said slip frame for engaging the surrounding well surface to limit movement of said friction means;

d. latch means including a first latch member connected to said friction means and a second latch member connected to said hanger body for limiting relative movement between said friction means and said hanger body; and e. lost motion coupling means so connecting said slip frame with said friction means for permitting limited longitudinal movement therebetween.

2. Apparatus as defined in claim 1 wherein:

a. said first and second latch members in a first configuration prevent wedging action of said wedge means with said slips against said well surface;

b. said first and second latch members in a second configuration permit wedging action of said wedge means with said slips against said well surface; and c. said first and second latch members may be moved from said first configuration to said second configuration by manipulation of said hanger body with said second latch member relative to said well as said friction means engages said well surface to resist movement of said first latch member while said lost motion coupling means permits longitudinal movement of said slip frame and slips relative to said friction means.

3. Apparatus as defined in claim 2 wherein said lost motion coupling means permits rotational movement of said slip frame and slips relative to said friction means.

4. Apparatus as defined in claim 3 wherein said slip frame is rotationally anchored relative to said wedge means so that said slips may be maintained rotationally aligned with wedge surfaces arrayed about said hanger body as parts of said wedge means.

5. Apparatus as defined in claim 4:

a. wherein said wedge means comprise at least two sets of wedge surfaces longitudinally displaced along said hanger body; and b. including a set of slips rotationally aligned with each set of wedge surfaces.

6. Apparatus as defined in claim 5 wherein each set of wedge surfaces comprises at least two separate wedge surfaces with corresponding separate slips, and wherein such separate wedge surfaces and corresponding slips in all such sets are aligned with separate wedge surfaces and corresponding slips in all other such sets longitudinally displaced along said hanger body.

7. Apparatus as defined in claim 1 wherein said hanger body may be selectively manipulated relative to said well in a first longitudinal direction sense with said second latch member while said friction means resists longitudinal movement of said first latch member relative to said well, and said lost motion coupling means permits longitudinal movement of said slip frame and slips with said hanger body relative to said friction means, said hanger body may be rotated relative to said well with said second latch member while said lost motion coupling means permits rotation of said slip frame and slips with said hanger body relative to said friction means which resists rotation of said first latch member, and said hanger body may be selectively manipulated relative to said well in a second longitudinal direction sense with said second latch member while said friction means resists longitudinal movement of said first latch member and limits longitudinal movement of said slip frame and slips relative to said well and said hanger body, to drive said wedge means against said slips whereby said slips may be wedged between said surrounding well surface and said wedging means so that said support apparatus may be supported by said surrounding well.

8. Apparatus as defined in claim 7:

a. wherein said wedge means comprise at least two sets of wedge surfaces longitudinally displaced along said hanger body; and b. including a set of slips rotationally aligned with each set of wedge surfaces.

9. Apparatus as defined in claim 8 wherein each set of wedge surfaces comprises at least two separate wedge surfaces with corresponding separate slips, and wherein such separate wedge surfaces and corresponding slips in all such sets are aligned with separate wedge surfaces and corresponding slips in all other such sets longitudinally displaced along said hanger body.

10. Apparatus as defined in claim 7 wherein said slip frame is rotationally anchored relative to said wedge means so that said slips may be maintained rotationally aligned with wedge surfaces arrayed about said hanger body as parts of said wedge means.

11. Apparatus as defined in claim 1 wherein said latch means comprise a pin-and-slot assembly with one of said first and second latch members comprising at least one such pin residing in at least one such corresponding slot included in the other of said first and second latch members.

12. Apparatus as defined in claim 1 wherein said lost motion coupling means so connects said slip frame with said friction means while allowing rotational motion therebetween.

13. Apparatus as defined in claim 1 wherein said lost motion coupling means comprise:

a. a first coupling member carried by said friction means; and b. a second coupling member carried by said slip frame and linked with said first coupling member to permit rotational motion between said slip frame and said friction means and limited longitudinal motion therebetween.

14. Apparatus as defined in claim 13 wherein:

a. said first coupling member comprises at least one arcuate flange member carried on a generally elongate first coupling body;

b. said second coupling member comprises at least one arcuate flange member carried on a generally elongate second coupling body;

c. said first and second coupling bodies are mutually telescoped with said corresponding flange members mutually opposed, permitting longitudinal motion between said first and second bodies as said bodies move by each other, said flange members engaging to limit such relative longitudinal motion in one direction sense.

15. Apparatus as defined in claim 14 wherein at least one of said first and second coupling bodies comprises a plurality of circumferentially arranged collet fingers equipped with said flange members toward the free ends of said fingers.

16. Apparatus as defined in claim 1 wherein:

a. said slip frame comprises at least one elongate frame member carrying at least one slip; and b. said frame member is constrained by said wedge means to be generally rotationally fixed relative to said wedge means.

17. Apparatus as defined in claim 16 wherein said frame member resides in a recess provided by said wedge means to be so restrained thereby.

18. Apparatus as defined in claim 17 further comprising cover means overlying said frame member in said recess.

19. Apparatus as defined in claim 18 further comprising spacer means carried by said frame member for cooperating with said cover means to maintain said frame member, and said slip carried thereby, relatively close to said hanger body.

20. A method of suspending support apparatus within a well, comprising the following steps:

a. providing a plurality of slips included as parts of said support apparatus aligned rotationally with respective wedges of said support apparatus;

b. providing friction apparatus as part of said support apparatus for frictionally engaging the surface of the surrounding well, and providing said friction apparatus latched to said support wedges to prevent longitudinal movement of the wedges to transversely align with the slips to wedge the slips to the well surface in anchoring engagement;

c. moving the wedges longitudinally and rotationally relative to the friction apparatus to release the latching to permit such transverse alignment between the slips and the wedges, while maintaining the slips rotationally aligned with respective wedges and allowing the slips to move longitudinally relative to the friction apparatus; and d. moving the wedges longitudinally relative to the friction apparatus and the slips to transversely align the wedges relative to the respective slips to wedge the slips in anchoring engagement to the surface of the surrounding well.

21. A method as defined in claim 20 wherein the step of rotating the wedges relative to the friction apparatus includes rotation of the slips with the wedges relative to the friction apparatus.

* * * * *